United States Patent [19]

Auer

[11] 4,025,265

[45] May 24, 1977

[54] CONCRETE TIE FORMING SYSTEM

[75] Inventor: Peter Auer, Ottobrunn, Germany

[73] Assignee: Dyckerhoff & Widmann Aktiengesellschaft, Munich, Germany

[22] Filed: Oct. 15, 1975

[21] Appl. No.: 622,761

[30] Foreign Application Priority Data

Oct. 15, 1974 Germany ..... 2448919

[52] U.S. Cl. ..... 425/211; 214/1 QA; 425/424; 425/432; 425/439; 425/453

[51] Int. Cl.[2] ..... B28B 1/08; B28B 13/05

[58] Field of Search ..... 249/137; 425/211, 432, 425/439, 453–454, 456, 424; 214/1 Q, 1 QA

[56] References Cited

UNITED STATES PATENTS

| | | | |
|---|---|---|---|
| 1,533,830 | 4/1925 | Cochran | 249/137 |
| 3,611,518 | 10/1971 | Glass | 425/439 |
| 3,669,283 | 6/1972 | Brown, Jr. | 214/1 Q |
| 3,825,394 | 7/1974 | Pietrowiak | 425/211 |

FOREIGN PATENTS OR APPLICATIONS

| | | | |
|---|---|---|---|
| 877,265 | 12/1942 | France | 425/439 |
| 179,399 | 5/1922 | United Kingdom | 425/439 |

*Primary Examiner*—Robert L. Spicer, Jr.
*Assistant Examiner*—John McQuade
*Attorney, Agent, or Firm*—Toren, McGeady and Stanger

[57] ABSTRACT

Apparatus for supporting, transporting and rotating mold forms for producing concrete reinforced ties wherein a gantry includes a pair of rotatable clamping devices on opposite ends thereof whereby the mold forms may be held in a position to be filled with concrete, moved to a mold dismantling position while being rotated through an angle of 180° with the concrete ties being subsequently removed from the mold forms. The rotatable clamping devices include vise means for supporting the mold forms and clamping means for holding the mold forms in their assembled condition during rotation thereof through 180° while permitting dismantling of the molds after they are brought into their inverted position. The gantry device is movable over a production and dismantling area and means are provided for stacking the finished concrete ties.

12 Claims, 14 Drawing Figures

FIG. 11
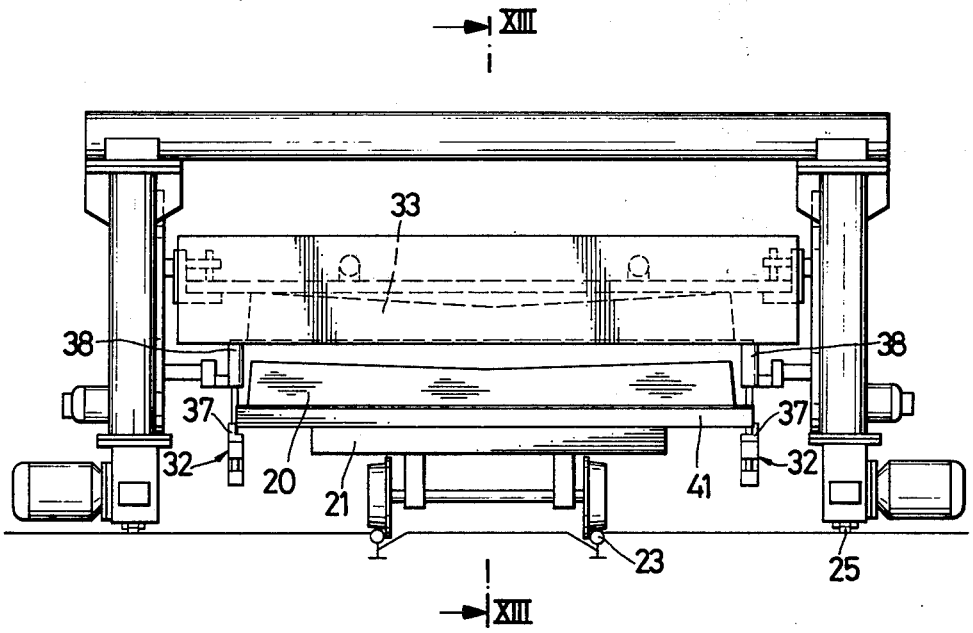
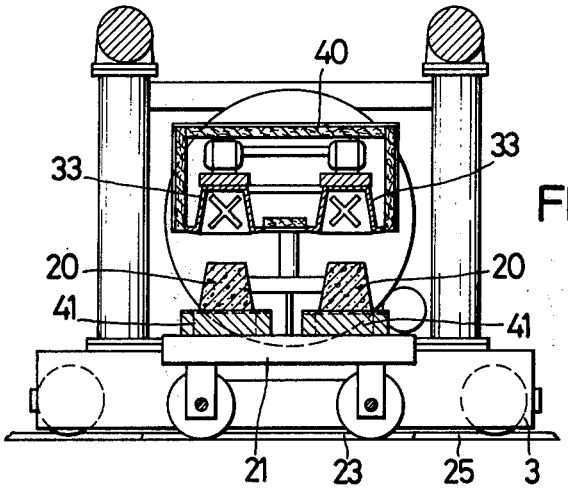
FIG. 13

CONCRETE TIE FORMING SYSTEM

BACKGROUND OF THE INVENTION

The present invention relates generally to apparatus for producing concrete reinforced ties or girders and more particularly to equipment for handling and transporting mold forms within such concrete reinforced ties are made.

In the production of prestressed concrete ties, several pairs of molds or casing forms are generally used in a production technique which involves a certain cyclical procedure. The mold forms are first cleaned and, subsequently, means are installed whereby steel reinforcing elements of the ties may be secured in the molds. Clamping means may be provided and bars into which the clamping means can be threaded may be subsequently installed. Thereafter, the molds are filled with concrete and compressed.

In order to enable quick reuse of the mold forms, the finished ties must be dismantled from the mold forms by rotating the forms through an angle of 180°. Subsequently, the finished ties are placed on special supports whereby the ties may be subjected to finishing operations or treatment such as exposure to a steam bath in order to accelerate the setting of the concrete. The ties are then prestressed after the final hardening of the concrete.

These operations can be extremely time consuming and generally involve a substantial degree of manual labor, even if automated or synchronized systems can be applied and maintained in the production process.

Thus, it is an object of the present invention to provide means for improved mechanization of the manufacturing apparatus for concrete reinforced ties and to enable production of a qualitatively improved product.

SUMMARY OF THE INVENTION

Briefly, the present invention may be described as apparatus for producing concrete reinforced ties comprising mold means for receiving therein poured concrete in order to form the ties. A gantry is provided for transporting the mold means between a filling location and a mold dismantling location and rotatable clamping means are arranged on the gantry for clamping the mold means therein and for enabling rotation of the clamped mold means through an angle of about 180° from a position wherein the molds are filled to a position wherein the filled molds are dismantled and the formed concrete ties deposited therefrom. The rotatable clamping means include a pair of rotatable clamping devices each aligned with the other across the gantry and each including means for holding the molds in assembled condition with the concrete ties therein while the molds are rotated through the 180° angle. Means are also provided for synchronously rotating the rotatable clamping means so that the molds, while held in the clamping means may be simultaneously moved from one production location to another while being rotated or inverted for dismantling thereof.

The gantry is arranged to span the production area of the molds and is mounted on tracks to be displaceable transversely of its standing direction.

The rotatable clamping devices, which are axially aligned across the gantry and synchronously driven, are provided with means for firmly gripping the molds as they are rotated through a 180° angle and they are also provided with means for holding the molds in assembled form with the finished parts within the molds during rotation thereof while subsequently enabling emptying of the molds and depositing of the dismantled finished parts at a dismantling location.

The rotatable clamping means are preferably arranged on rotating tracks, one each being provided on opposite sides of the gantry. Each rotating track is preferably driven by a separate motor and each of the rotatable clamping devices is movable in horizontal directions.

Each of the rotatable clamping devices includes vise means for supporting the molds with the vise means being designed to include an L-shaped member having a horizontally extending leg and vise bar acting against the horizontal leg of the L-member. The molds include lugs or brackets which may be inserted between the vise bar and the L-leg of the vise means and after the vise means have been moved horizontally into position, the lugs on the molds may be clamped between the vise bar and the horizontal leg of the L-member.

The means for holding the molds in assembled form during rotation thereof includes clamping bars which are also horizontally movable with the vise means in order to clamp a cover upon the open-top mold form. After rotation to an inverted position, the clamping bars may be lowered and the cover member removed from the mold forms to enable removal therefrom of the finished concrete ties.

In one aspect of the present invention the molds are arranged to be fixed relative to the rotatable clamping devices thereby avoiding the necessity for clamping and unclamping of the molds during the production process.

Furthermore, vibrating means may be arranged directly upon the molds and each of the mold forms may be surrounded by a sound-absorbing cover.

Furthermore, the apparatus may include means for charging the molds with concrete to initiate the forming process.

The advantages of the device according to the present invention primarily involve the fact that the mold forms remain constantly in engagement with one and the same means from the time of compression of the concrete to the time of dismantling, these means being capable of performing all the operations during this period upon manual actuation or in automatic succession. The result is not only a savings in labor costs, but also a qualitative improvement in the product which becomes, to a great extent, independent of the skill of manual workers. The greater accuracy of the sequence of operations involved also results in greater accuracy in the dimensions of the ties which are formed, which is of importance particularly if such ties are to be subsequently placed and used in railroad beds.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described prefered embodiments of the invention.

DESCRIPTION OF THE DRAWINGS

In the drawings:

FIGS. 9–11 are side elevations showing another embodiment of the apparatus of the present invention in different operating stages;

FIG. 13 is a sectional view taken along the line XIII—XIII of FIG. 11; and

DETAILED DESCRIPTION OF THE PREFERRED EMBODIMENTS

Figure 1:
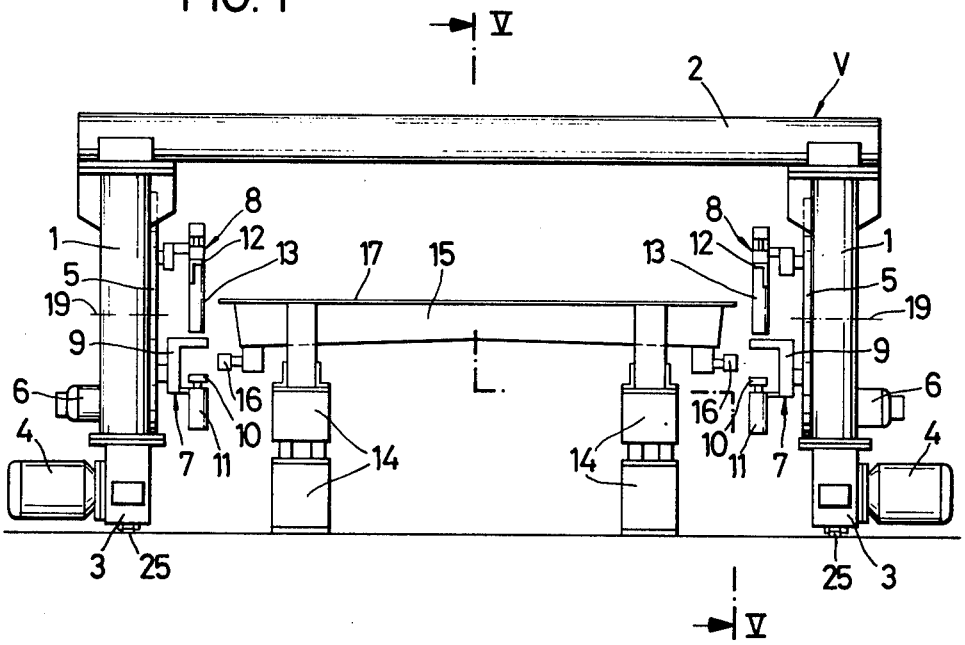
FIGS. 1 through 4 are side elevations of the apparatus of the present invention showing the apparatus in different operating positions.
Figure 5:
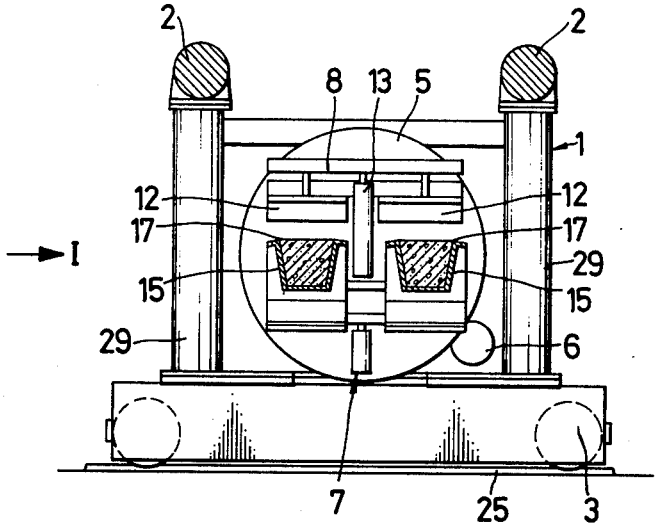
FIG. 5 is a cross-sectional view taken along the line V—V of FIG. 1.
Figure 2:
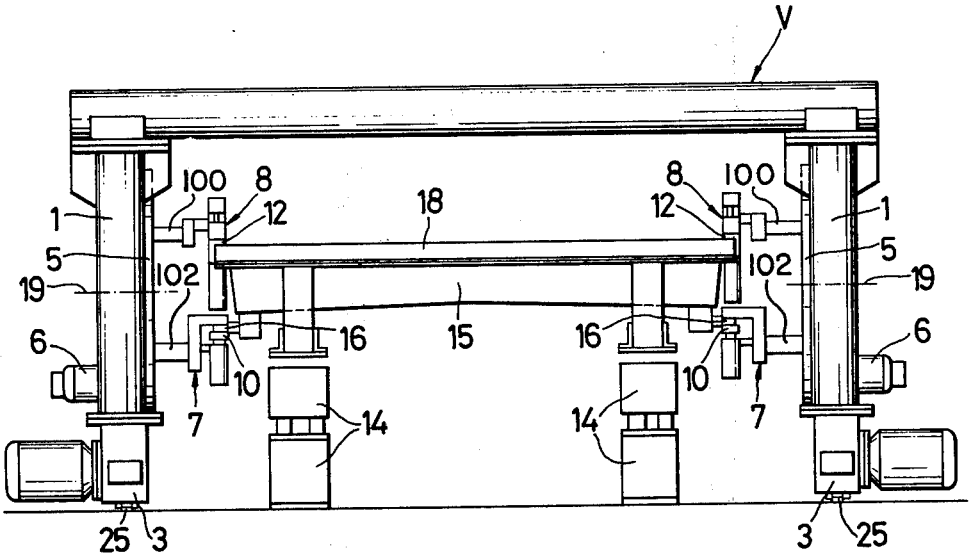

Referring now to the drawings wherein like reference numerals are used to refer to similar parts throughout the various figures thereof, and particularly to FIGS. 1–4, the apparatus of the present invention generally labelled V includes a gantry comprising a pair of upstanding support members of heads 1 which are joined together to form a frame by a pair of connecting girders 2, best seen in FIGS. 1 and 5. On the lower ends of the heads 1 there are arranged travelling gears 3 including wheels which are adapted to run upon tracks 25. Each gear 3 is driven by a separate traction motor 4.

In each of the heads 1 there is arranged a rotating clamping device or mount 5 which comprise the rotating clamping means of the invention. The rotating clamping devices 5 involve standard commercial components and are arranged between supports 29 and each rotating device 5 is adapted to be turned by means of an associated motor 6. The motor 6 enables rotation of the clamping devices 5 either clockwise or counterclockwise through an angle of 180°. The rotating mounts 5 may be rotatively mounted upon the heads 1 in one of several ways obvious to those skilled in the art. For example, the mounts may be rotated upon tracks provided in the heads 1.

On each of the clamping devices 5 there is arranged a vise mechanism 7 which is adaptable to have clamped therein a pair of molds or casing forms 15. Additionally, each rotating clamping device 5 includes a clamping mechanism 8 which operates to hold the molds 15 in assembled form and to facilitate dismantling thereof for removal therefrom of a finished tie.

Each of the vise means 7 is formed with an L-shaped vise member 9 and a vise bar 10. The vise bar 10 is connected with the piston of a hydraulic cylinder 11 and as a result of operation of the cylinder 11 the bar 10 may be moved vertically toward and away from an upper horizontal leg of the L-shaped device 9 in order to permit a vice-like clamping action to be developed between the horizontal leg of the L-member 9 and the bar 10.

Each of the clamping members 8 includes a pair of clamping bars 12 which are arranged on both sides of a hydraulic cylinder 13 and which may be moved by the cylinder 13 in the direction of the vise means 7. Both the vise means 7 and the clamping devices 8 perform synchronized horizontal and vertical movements, as will be more fully described hereinafter.

The vises 7 and the clamping members 8 are so arranged upon the rotating clamping devices 5 that sufficiently large openings will be formed at least in the central regions of the devices 5 in order to permit installation of auxiliary devices for performing additional operations on finished parts. For example, means may be provided for automatic drawing of bars for the production of recesses for clamping means, the production of clamping means, production of clamping hole recesses on the tie forms, and similar operations, the means therefor not being shown in the drawings.

Figure 7:
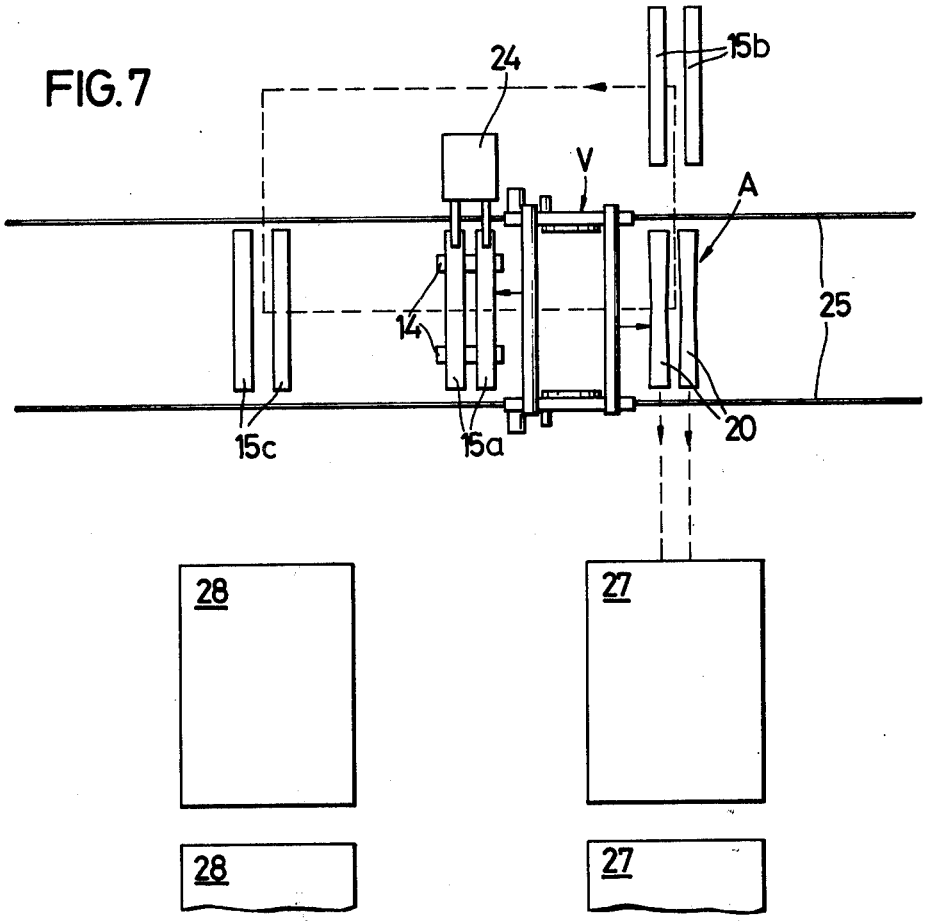
FIGS. 7 and 8 are schematic plan views depicting the operation of various production arrangements utilizing the device of the present invention.

In operation, when the gantry is in a the position shown in FIG. 1, two mold forms 15 filled with concrete will rest upon a jarring table 14, also shown in FIG. 7, and the vise means 7 and the clamping devices 8 will be in horizontally retracted position having been moved away from the mold forms 15 as viewed in FIG. 1. The vise means 7 are in a position with the vise bars 10 being moved vertically downwardly and below a pair of brackets 16 which extend from the mold forms 15. The clamping bars 12 of the clamping members 8 are arranged in a vertically intermediate position above upper edges 17 of the mold forms 15.

In order to clamp the mold forms 15 in the vise means 7, the vise means 7 are moved horizontally toward the mold forms 15 until the vise bars 10 are located in a position below the brackets 16 on the molds 15. Subsequently, the bars 10 are vertically raised by operation of the hydraulic means 11, and the brackets 16 will be engaged between the bars 10 and the horizontal leg of the L-member 9 with the molds 15 being lifted from the jarring table 14 and held by the vise means 7 on opposite sides of the molds. Thus, the molds 15 with the formed ties arranged therein will now be clamped within the device V.

After the molds 15 have been lifted and clamped, cover plates 18 are placed over the open ends of the molds 15. Subsequently, the clamping members 8 with the clamping bars 12 are moved horizontally by driving means 100 over the ends of the covering plates 18 and the clamping bars 12 are lowered into engagement with the ends of the plates 18. The plates 18 will thus be fixed upon the molds 15 and the device will be in the condition depicted in FIG. 2. Of course, the vise means 7 may also be moved horizontally by cylinders 102 similar to driving means 100.

The device V is now moved by means of the travelling gears 3 upon the tracks 25 to a dismantling station labelled A shown in FIG. 7. During this travel, the molds 15 filled with concrete and the supporting plates 18 clamped thereon will be turned by means of the rotating tracks of the rotatable clamping devices 5 and the motor 6 about a horizontal axis 19 with the degree of rotation being 180°.

Figure 3:
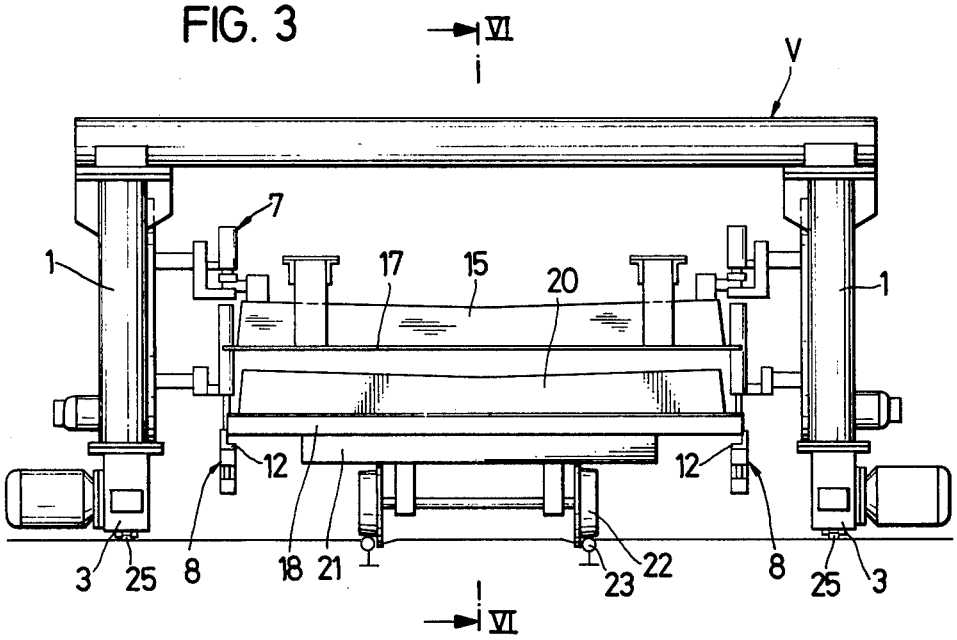
Figure 6:
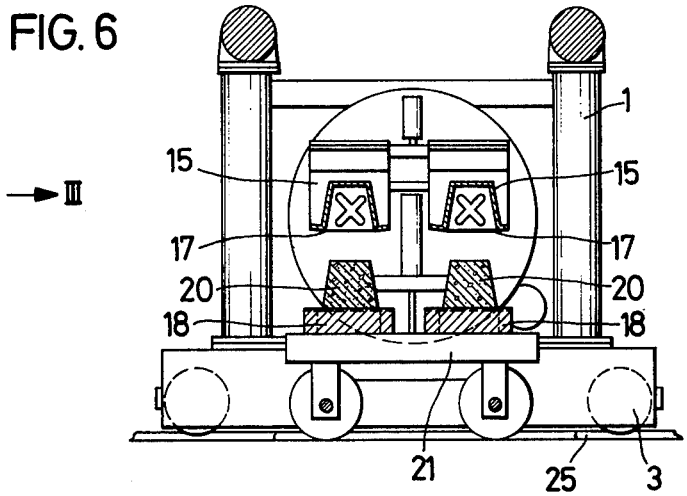
FIG. 6 is a sectional view taken along the line VI—VI of FIG. 3.

After the device has been moved to the dismantling station A, any recessed parts which must be removed prior to dismantling from the forms may be removed. Subsequently, the clamping means 8 with the clamping bars 12 upon which the plates 18 rest are vertically lowered in a synchronous fashion. The formed ties 20 are dismantled from the molds 15 and FIG. 3 shows the device V in this operating stage with the forms 15 being turned to 180° with the dismantled ties 20 resting upon the supporting plates 18 being deposited upon a truck 21. This truck may be moved by means of wheels 22 over tracks 23 extending parallel to the device V, as shown in FIG. 6. The molds 15 are still clamped within the vise means 7.

The lowering of the clamping means 8 is completed when there is provided sufficient clearance between the edges 17 of the molds 15 and the ties 20, on the one hand, and between the clamping bars 12 and the plates 18 on the other hand. The latter spacing is achieved by placing the plates 18 with the ties 20 upon the truck 21. In order to transport the formed ties 20 out of the turning range of the device, the two clamping members 8 with the clamping bars 12 are moved again horizontally toward the heads 1. The device may now be moved with its travelling gears 3 upon the tracks 25, or the truck 21 may be moved on the tracks 23, so that the forms 15 will now be cleared and may be turned back from their inverted position into their upright position by rotation through 180°.

Figure 4:
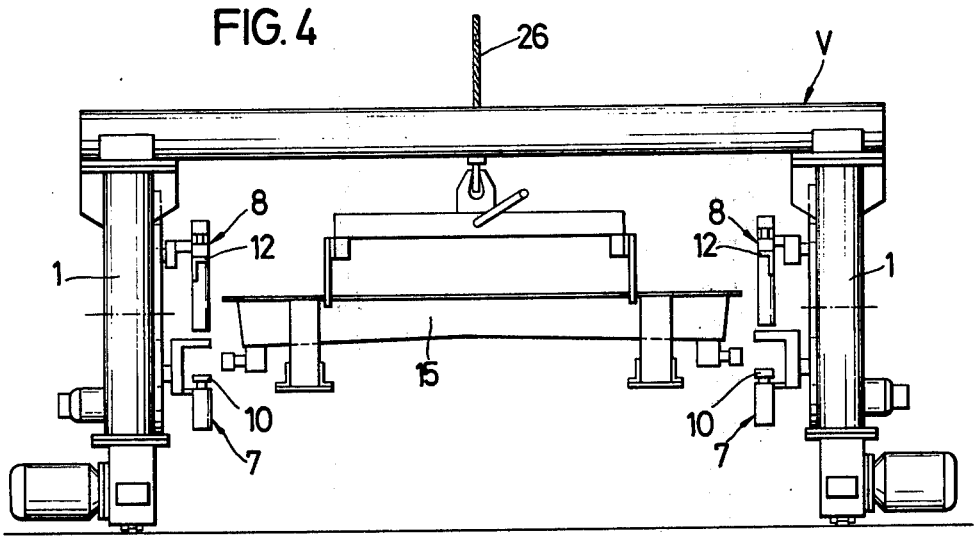

FIG. 4 shows in side elevation the device V with the molds 15 turned upright through 180° after they have been dismantled and after they have been detached from the vise means 7 with a crane rope 26 being provided for support. The clamping members 8 with the clamping bars 12, as well as the vise means 7 with the vise bars 10 may then again be moved horizontally toward the heads 1 back to their starting positions.

The device V of the present invention may be used in two ways. First, the device may be used individually or, secondly, it may be used in pairs for the manufacture of prestressed concrete ties. In FIG. 7 there is shown the use of a device V with molds for a production line in which prestressed concrete ties may be formed. A pair of forms 15*a* are arranged upon a jarring table 14. Two forms 15*b* are in a position where they have been prepared to be filled with concrete and another pair of forms 15*c* are in a position ready to be filled with concrete adjacent to the jarring table 14. The device V is located between the jarring table 14 and the newly formed ties 20. Filling of the molds is effected by means of a concrete feeder 24 associated with the jarring table 14.

When the poured concrete has been sufficiently compressed within the two casing forms 15*a* on the jarring table 14, the device V is moved on tracks 25 over the jarring table 14 and the molds are lifted with the supporting plates 18 being locked in place. Subsequently, the device V is moved to the dismantling station A while the mold forms are turned through 180° to be rotated in an inverted position with the newly formed ties 20 being subsequently dismantled therefrom.

After the empty mold forms 15*a* have been removed from the device V, the latter is returned to the jarring table 14 in order to engage the filled and compressed pair of mold forms 15*c* while the mold forms 15*b* are brought into the place previously occupied by the forms 15*c*.

Newly formed ties 20 are arranged in stacks 27 which are placed in air conditioned chambers (not shown) in order to be treated to accelerate the setting of the concrete. When the row of stacks 27 to the right of the jarring table 14 in FIG. 7 has accumulated thereon a sufficient number of ties 20, the device V is moved upon the tracks 25 over the jarring table 14. It may then be brought into operation to the left of the jarring table 14 and it may be utilized to form a row of stacks 27 of newly formed ties. This cycle involving three pairs of the mold forms 15*a*, 15*b* and 15*c* may, at this point, be reversed.

Figure 8:
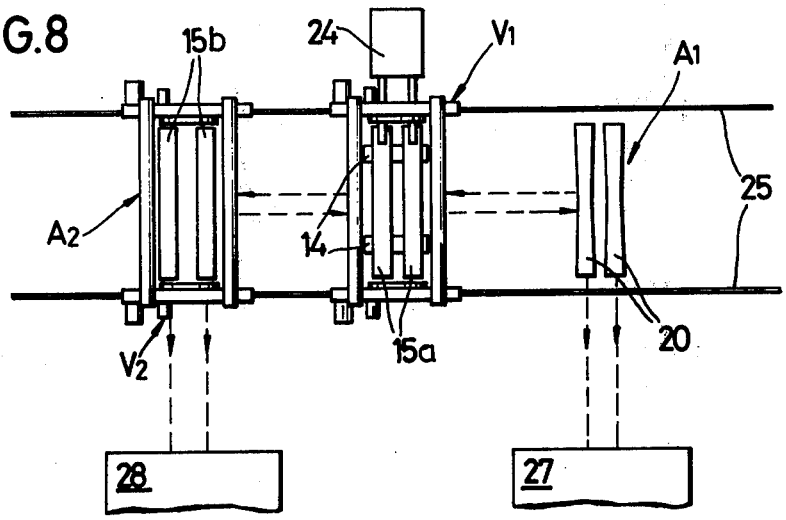
Figure 9:
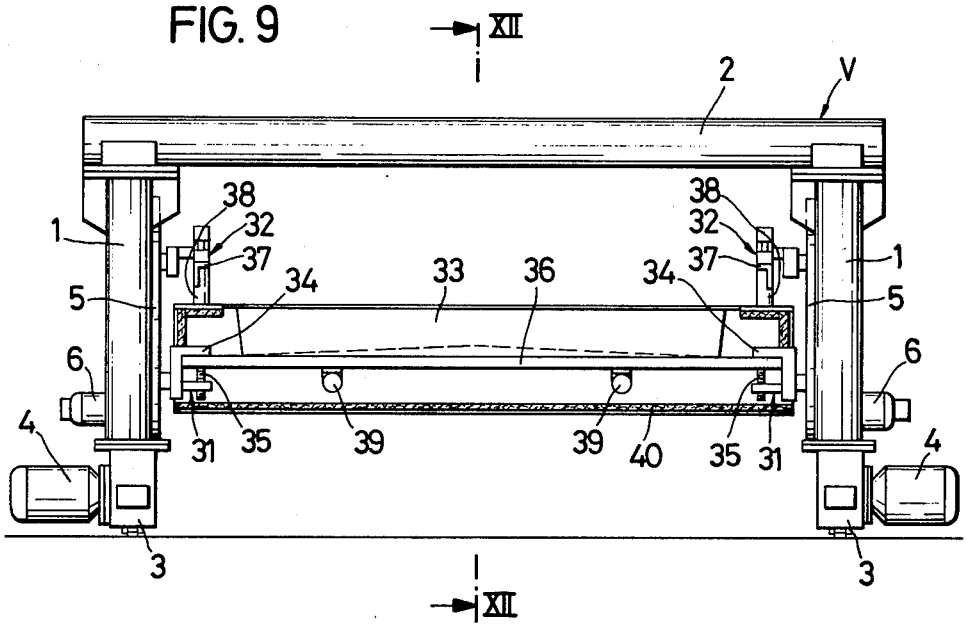
Figure 10:
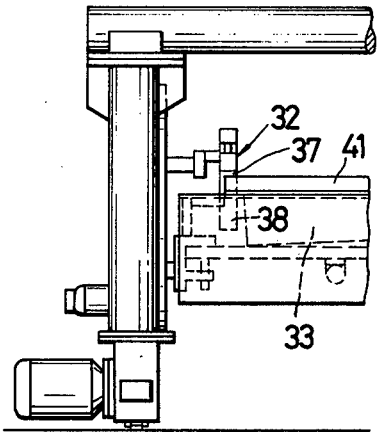
Figure 12:
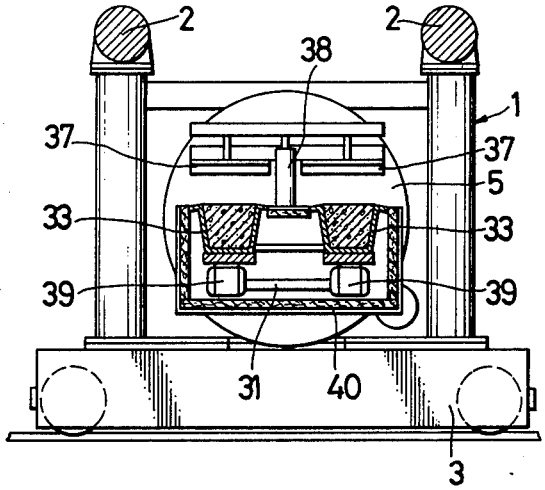
FIG. 12 is a sectional view taken along the line XII—XII of FIG. 9.

In FIG. 8 there is depicted a procedure wherein a pair of devices in accordance with the present invention may be used within the framework of a production plant which enables adequate manufacturing with one pair of molds. A first device V1 having two forms 15*a* is located above a jarring table 14 to which there is assigned a concrete feeder 24. After the concrete has been poured and compressed, the device V1 lifts the forms 15*a* from the jarring table 14, the plates 18 are locked in place and the device V1 is moved upon tracks 25 to a dismantling station A while the molds are rotated through 180° into an inverted position, dismantled and the form ties 20 removed therefrom. The empty forms 15*a* remain in the device V1 and, after they have been again rotated through 180° from the inverted position back to the upright position they are prepared for further filling with concrete and brought again to the jarring table 14 of the assembly. While the molds 15*a* are dismantled by the first device V1, a second device V2 moves over the free jarring table 14 and an operation similar to that performed by the first device may be effected. The dismantling and jarring cycles are so correlated relative to each other that the two devices V1 and V2 will not interfere with the performance of each. Associated with the device V2 is a second dismantling station A2 and each device may operate to form one row of stacks 27, 28, respectively.

As will be noted from the description of the embodiment of the present invention set forth above, the apparatus of the invention operates to grip the molds filled with concrete, to transport them during the production process and to enable dismantling operations to be performed. Other operations, such as the preparation of the mold forms, incorporation of reinforcement elements or of bars for the production of recesses into which the clamping means may be subsequently introduced, the charging and compression of the concrete, and the drawing of the bars, may be effected substantially by manual means or by stationary means. Generally, this will require that the production process be performed within a closed room.

The device according to the invention also involves a prerequisite that the means necessary for carrying out these additional operations may also be integrated into the device of the invention so that a generally self-contained mechanism may be provided.

In FIGS. 9–14 another embodiment of the invention is shown. This embodiment also consists of a pair of heads 1 which are joined by connecting girders 2 and which are provided at the bottom ends with travelling gears and with traction motors 4. Into the two heads 1 there are again arranged rotating clamping devices 5 with respective motors 6 being provided. On each of the rotating clamping devices 5 there is secured a vise means 31 and a clamping member 32.

The vise means 31 depicted in the embodiment in FIGS. 9–14 are generally similar to the vise means 7 of the previously described embodiment, and in the embodiment of FIGS. 9–14 the vise means 31 are so designed that mold forms 33 may be continuously supported and fixed in the device V. In this embodiment, unlike the previously described embodiment, the device means need not clamp and unclamp the molds during the production operation. The clamping means 31 include a vise strap 34 against which a threaded bolt 35 may be brought into engagement to effect a vise-like grip. A plate 36 formed on the bottom of the mold form 33 may be clamped between the vise strap 34 and the threaded bolt 35 to be continuously there held during the production operation.

Clamping members 32, similar to the clamping members 8, are also provided and again a pair of clamping bars 37 are utilized with the clamping members being movable vertically by means by a hydraulic device 38. Furthermore, the clamping members may be horizontally displaceable in a manner similar to that described above. In the embodiment of FIGS. 9–14, the necessity for displacing the vise means 31 horizontally may be eliminated.

On each of a pair of mold forms 33 there are secured external vibrating means 39 with the molds 33 also being surrounded by a sound absorbing medium 40 in order to reduce noise. Of course, it will be apparent that although in the present embodiment the molds 33 are intended to be maintained permanently within the apparatus, they may of course be replaced if they should become damaged or if they must be exchanged with molds of different dimensions.

The vise means 31 and the clamping members 32 are secured upon the rotating clamping devices 5 such that openings are provided which are sufficiently large to permit the installation or attachment or auxiliary devices in the apparatus. Accordingly, a concrete charging station, at least one storage tank for the concrete, a drawing device for matrix bars for the production of recesses, or means for drawing the clamping hole recesses, may be arranged laterally upon the device. These known devices are omitted from the drawings in order to simplify the depiction of the invention.

The method of operation of the embodiment according to FIGS. 9–14 is substantially similar to that described in connection with the prior embodiment. After filling with fresh concrete from a concrete feeder (not shown) the external vibrators 39 may be set in motion in order to compress the poured concrete (see FIGS. 9 and 12). Additionally, other vibrators which may be in the form of, for example, jarring boards, may be applied on the top of the molds 33. After the concrete is compressed, supporting plates 41 are placed over the molds 33 and this plate is pressed by means of the clamping bars 37 of the clamping members 32 (see FIG. 10).

Subsequently, the clamping mold forms 33 are turned by means of the rotating tracks of the rotatable clamping devices 5 and the ties are dismantled by operation of the hydraulic means 38 associated with the clamping members 32. The newly formed ties 20 are then placed upon a truck 21 which operates on tracks 23 (see FIGS. 11 and 13).

Figure 14:
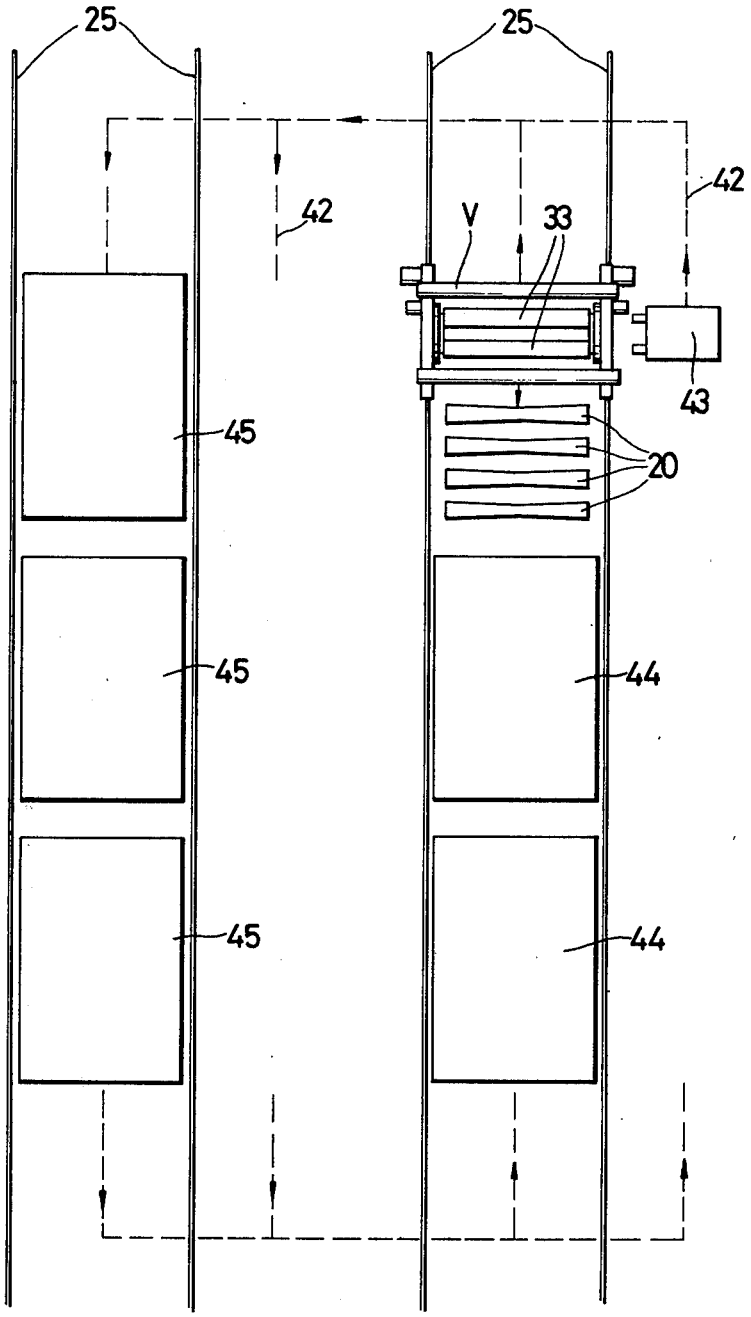
FIG. 14 is a schematic plan view showing the utilization of a device according to the embodiments of FIGS. 9–13 in a production layout.

A dual track production line for this device is schematically depicted in FIG. 14 in plan view. The device V in this arrangement moves over two pairs of tracks 25 extending parallel to each other and spaced apart a predetermined distance. At the end of the track pairs there is provided a cross-displacement device (not shown) to permit transposition of the device V from one pair of tracks to the other. Laterally of the two track pairs there are arranged tracks 42 (indicated schematically in this embodiment) which are utilized for the concrete charging station 43 with which the molds 33 are charged.

The ties produced and dismantled by the device of this embodiment are piled by means of the truck 21 and corresponding lifting gears upon stacks 44 in which they may be treated, for example, with steam in order to speed up the setting of the concrete. The arrangement of two such track pairs side-by-side has the advantage that, while ties are being manufactured and hardened on one track, e.g. the right track shown in FIG. 14, the ties produced and hardened the previous day on the opposite track may already be prestressed an conveyed to the stacks 45.

In this manner, a highly efficient and concentrated production line for prestressed concrete ties may be provided which is substantially free of outer influences. Such a production plant is by no means limited to the production of prestressed concrete ties but, rather, other finished concrete parts may, of course, be produced in the same manner provided comparable operations are involved.

While specific embodiments of the invention have been shown and described in detail to illustrate the application of the inventive principles, it will be understood that the invention may be embodied otherwise without departing from such principles.

What is claimed is:

1. Apparatus for producing concrete ties comprising mold means for receiving therein poured concrete to form said ties, a gantry operatively associated with said mold means for transporting said mold means between a filling location and a dismantling location, rotatable clamping means on said gantry for clamping said mold means therein and for holding said mold means while rotating said clamped mold means through an angle of about 180° from an upright position wherein the molds are filled to an inverted position wherein the formed concrete ties are dismantled from said mold means, said rotatable clamping means including a pair of rotatable clamping devices aligned with each other across said gantry with each of said clamping devices including means for holding said mold means in filled condition with said concrete ties therein while said mold means are rotated through said 180° angle, and means arranged on said gantry and engaging said clamping means for synchronously rotating said rotatable clamping means with said mold means clamped therein.

2. Apparatus according to claim 1 wherein said gantry includes a pair of upstanding support members located on opposite sides thereof and wherein said rotatable clamping devices are provided with rotating means enabling rotation of said clamping devices relative to said support members, with one of said devices being mounted in each of said support members.

3. Apparatus according to claim 2 including individual motor means for separately rotatively driving each of said clamping devices.

4. Apparatus according to claim 1 including means operatively associated with said rotatable clamping devices for driving each of said rotatable clamping devices horizontally into and out of position for clamping engagement with said mold means.

5. Apparatus according to claim 1 wherein each of said rotatable clamping devices comprise vise means including and L-shaped vise member having a horizontal leg, a vise bar and means for driving said vise bar into and out of clamping engagement with said horizontal leg, and wherein said mold means include bracket means clamped between said vise bar and said horizontal leg.

6. Apparatus according to claim 5 wherein said means for holding said mold means in filled condition comprise clamping bars having a longitudinal dimension extending generally parallel to said horizontal leg of said vise member and adapted to be moved toward and away from said mold means for applying pressure to said mold means while said mold means is held in said vise means to hold said mold means in filled condition.

7. Apparatus according to claim 6 wherein said mold means comprise mold forms having an open top with cover plates being provided for covering said open top of said mold forms; said clamping bars being arranged on said rotatable clamping device to clamp said cover plates onto said mold forms to hold said mold forms closed while said mold forms are turned through an angle of 180° by said rotatable clamping devices, said clamping bars operating to apply pressure to said cover plates to support said ties within said mold means, and to be moved to release said pressure when said ties are to be removed from said mold means and said mold means are dismantled.

8. Apparatus according to claim 1 wherein said mold means include at least one pair of mold forms which are affixed to said rotatable clamping means.

9. Apparatus according to claim 8 including external vibrating means arranged on said mold means to effect vibration thereof.

10. Apparatus according to claim 8 including sound absorption means extending about said mold means.

11. Apparatus according to claim 8 including means operatively associated with said mold means arranged to be brought into position relative to said mold means for charging concrete into said mold means.

12. Apparatus according to claim 1 wherein said rotatable clamping means are located on said gantry supporting said mold means therebetween with said mold means extending in a generally horizontal direction longitudinally between said rotatable clamping means, said apparatus further including tracks having said gantry mounted thereon and upon which said gantry is movable, said tracks extending in a direction generally perpendicular to the longitudinal horizontal direction in which said mold means extend between said rotatable clamping means.

* * * * *